United States Patent [19]

Nichols, Jr.

[11] Patent Number: 4,622,040

[45] Date of Patent: Nov. 11, 1986

[54] TEXTILE DYEING PROCESS

[75] Inventor: David B. Nichols, Jr., Dalton, Ga.

[73] Assignee: RCA Corporation, Princeton, N.J.

[21] Appl. No.: 916,889

[22] Filed: Jun. 19, 1978

[51] Int. Cl.[4] ..... D06P 5/00

[52] U.S. Cl. ..... 8/478; 8/455; 8/484; 8/485; 8/680; 8/929

[58] Field of Search ..... 8/1 XB, 14, 15, 25, 8/478, 485

[56] References Cited

U.S. PATENT DOCUMENTS

| | | | |
|---|---|---|---|
| 545,420 | 8/1895 | Bamford | 8/1 XB |
| 617,772 | 1/1800 | Rettig | 8/14 |
| 790,718 | 5/1905 | Bucher | 8/14 |
| 1,210,279 | 12/1916 | Diener | 8/14 |
| 1,579,872 | 4/1926 | Lecjaky | 8/14 |
| 1,754,287 | 4/1930 | Shoemaker | 8/14 |
| 2,002,848 | 5/1935 | Cohen | 91/68 |
| 2,090,890 | 8/1937 | Howard et al. | 8/5 |
| 2,313,726 | 3/1943 | Atwell | 260/20 |
| 2,321,974 | 6/1943 | Bird | 8/14 |
| 2,359,776 | 10/1944 | Milne et al. | 8/65 |
| 3,220,793 | 11/1965 | Parsons | 8/14 |
| 3,414,368 | 12/1968 | Kitamura et al. | 8/64 |
| 3,468,694 | 9/1969 | Moritz et al. | 8/15 |
| 3,669,611 | 6/1972 | Shimauchi et al. | 8/14 |
| 3,756,770 | 9/1973 | Kahayushi et al. | 8/14 |
| 3,945,791 | 2/1976 | Bohrn | 8/14 |
| 3,963,428 | 6/1976 | Stark | 8/1 XB |
| 4,000,964 | 1/1977 | Newton | 8/14 |
| 4,010,709 | 3/1977 | Sayman et al. | 118/33 |
| 4,127,014 | 11/1978 | Miller et al. | 68/13 R |
| 4,146,362 | 3/1979 | Nichols | 8/485 |
| 4,189,302 | 2/1980 | Toland | 8/14 |

FOREIGN PATENT DOCUMENTS

| | | | |
|---|---|---|---|
| 763022 | 7/1971 | Belgium | 8/1 XB |
| 1964081 | 6/1971 | Fed. Rep. of Germany . | |
| 2147972 | 3/1973 | Fed. Rep. of Germany | 8/14 |
| 2148871 | 5/1973 | Fed. Rep. of Germany | 8/62 |
| 4540716 | 12/1977 | Japan | 8/14 |
| 490532 | 8/1938 | United Kingdom | 8/65 |
| 740291 | 11/1955 | United Kingdom | 8/65 |
| 1243903 | 8/1971 | United Kingdom | 8/14 |
| 1363129 | 8/1974 | United Kingdom | 8/14 |
| 1578039 | 10/1980 | United Kingdom . | |

OTHER PUBLICATIONS

Dawson, Jour. of Soc. of Dyers & Colorists vol. 90, pp. 235–238, Jul. 1974.

Amer. Dyestuff Reporter (ADR) Jul. 23, 1951, p. 478.

ADR Jun. 1971, pp. 25–31, Leifeld G.

German Publ. *Kusters* 1973.

Hall, A., The Standard Handbook of Textiles.

Wigfall, S. Textile Colorist Apr. 11, 1944, pp. 170–173.

*Primary Examiner*—A. Lionel Clingman

*Attorney, Agent, or Firm*—Joseph S. Tripoli; George E. Haas; William Squire

[57] ABSTRACT

A continuous process for dyeing a pre-wetted carpet includes the step of printing, in one dye color, a desired pattern on the tufts, compressing those of the tufts receiving the dye in the process. The tufted printed surface of the carpet is then covered with a viscous water-soluble gum and then drops of a second dye, which is less viscous than the gum, are applied to the viscous gum-wetted tufts. Then a third dye which is substantially less viscous than the second dye is applied over the entire tufted surface of the carpet.

10 Claims, 7 Drawing Figures

TEXTILE DYEING PROCESS

The present invention relates to a continuous process for dyeing textiles which is particularly suitable for carpeting.

Of interest are U.S. patent application Ser. No. 757,371, filed June 22, 1985, entitled "Textile Dyeing Process for Multicolor Nylon Carpet," by David Banks Nichols, Jr. (allowed), which is a continuation of U.S. patent application Ser. No. 916,900 filed June 19, 1978, entitled "Textile Dyeing Process" (abandoned); U.S. patent application Ser. No. 916,903, filed June 19, 1978, entitled "Textile Dyeing Process," by David Banks Nichols, Jr.; U.S. patent application Ser. No. 916,901, filed June 19, 1978, entitled "Textile Dyeing Process," by David Banks Nichols, Jr.; and U.S. patent application Ser. No. 916,893, filed June 19, 1878, entitled "Textile Dyeing Process," by David Banks Nichols, Jr., all of the above being assigned to the assignee of the present invention.

TAK dyeing, which is a relatively recent development in the carpet industry, is a continuous dyeing process in which dye is deposited, in drops, on the tufted side of the carpet. A wide variety of dye colors may be employed and different random color patterns obtained. Typical apparatuses which may be used for applying the dyes in drops are disclosed, for example, in U.S. Pat. Nos. 3,683,649; 3,800,568; 3,726,640; 3,731,503; 3,964,860 and 4,010,709.

The ever changing tastes of the public places a continuous demand on the carpet industry for new styles which are both pleasing and attractive. In my copending application Ser. No. 661,396, filed Feb. 25, 1976, now abandoned, I describe a method and apparatus, now in wide use, for producing one group of such styles. In this method, a layer of a liquid, such as a water soluble gum, is applied to the tufted surface of the carpeting and then drops of dye(s) are applied to the gum wetted tufts. The dye or dyes spread, blend, attenuate and provide, in the finished product, randomly varying patterns with gentle shading effects, which are pleasing to the eye.

I describe a second dye technique in my copending application Ser. No. 851,418, filed Nov. 14, 1977, now U.S. Pat. No. 4,146,362. Here a relatively viscous first dye is deposited, for example, onto, spaced regions of a textile and a less viscous second dye is then deposited onto regions of the textile which include the spaced regions. The first dye colors the regions of the textile it reaches in the first dye color and masks these regions from the second dye. The second dye colors the regions of the textile it reaches in the second dye color and does not substantially affect the regions of the carpet masked by the first dye. This process provides additional new and pleasing coloring effects; however, the market continually demands other pleasing styles.

In a process embodying the invention for dyeing a textile, a relatively viscous liquid, such as a water soluble gum, is deposited over first regions of the material. A first less viscous dye is then deposited on second spaced regions of the material which includes the first regions and a second dye substantially less viscous than either the first dye or the liquid is applied to regions which include the first and second regions.

Figure 1:
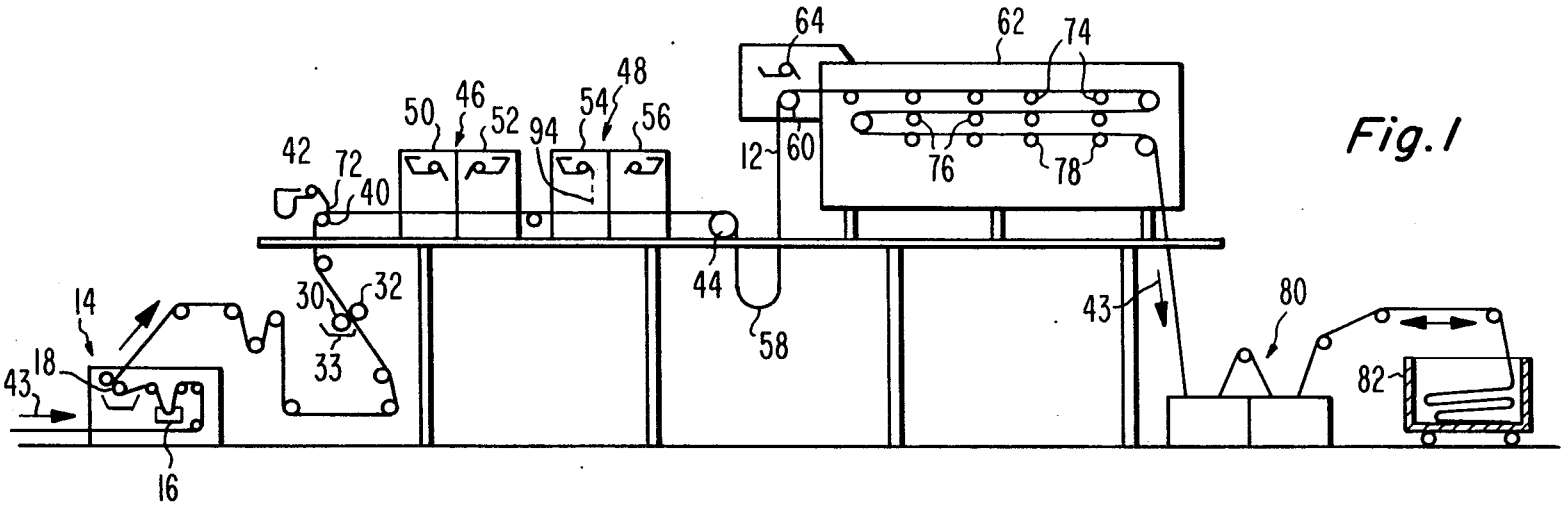
FIG. 1 is a schematic, side-elevational view of a carpet dyeing apparatus used to practice the process embodying the present invention.

The apparatus shown in FIG. 1 is particularly suitable for dyeing carpeting but may be used on woven or flocked textiles providing there is some pile height. Preferably, this pile height should be at least about ¼ inch. Carpeting 12 is fed from a supply roll (not shown) through a pad machine 14. Machine 14 includes a reservoir 16 containing a pre-wet solution through which the carpet passes. The carpet is then conveyed through two squeeze rollers 18 which remove sufficient pre-wet solution from the carpet tufts to provide a desired percent "liquid pick-up" in the carpet. "Percent pick-up" is a measure of the weight of the liquid in a given area of the carpet in particular is the ratio of the weight of the liquid in the given area of the carpet to the dry weight of that same area of the carpet multiplied by 100. In one particular form of the invention, the pre-wet solution in the reservoir is at room temperature and contains gum having a mixed viscosity preferably of about 50 centipoise (CPS) and a pH preferably of about 4. This viscosity may have a value in the range of 50 to 120 CPS. The gum helps maintain the tufts in a prone position after they are subsequently compressed, as discussed later. The pH may be in the range of 0 to 7.

Figure 7:
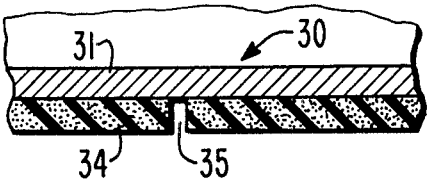
FIG. 7 is a section elevational view of a print roller used in the apparatus of FIG. 1.

After leaving the machine 14, the carpeting passes between a print roller 20 and a back-up roller 32, as show in FIG. 1. Referring to FIG. 7, the roller 30 shown in partial section comprises a cylinder a part of which is shown at 31 surrounded by a cylindrical sponge rubber printing pad 34 secured to the surface of the cylinder. The sponge rubber pad 34 has cut outs 35 in its surface forming the desired pattern.

The roller 30 extends across the entire breadth of the carpeting 12. The roller 30, FIG. 1, is immersed in a first dye bath reservoir 33, for printing the desired pattern. This first dye, in the reservoir 33, is somewhat viscous; for example, it may be about 200 centipoise (CPS) and is in first color ("color 1"). This dye is acidic and may have a pH of about 3. As the carpeting 12 passes between rollers 30 and 32, the cut out regions (such as 35) of the pad do not dye the carpet and create the areas 36*a*–36*e* of FIG. 3. The remainder of the pad 34 dyes ("prints") the tufts the pad makes contact with, compressing the tufts and causing them to bend over. Because of variations in density of the tufting, length of the particular tufts and possibly other factors, some tufts which have been printed may be bent over more than others which have been printed when they leave the print roller region. The first dye also tends to help retain the printed tufts in their bent over orientation due to the viscosity of this dye. Thus, the printed tufts generally are more bent over than the non-printed tufts.

The carpet web then advances upwardly and around roller 40, FIG. 1 and past a viscous liquid applicator 42.

An applicator of this type is described in detail in my copending application Ser. No. 661,396, filed Feb. 25, 1976. In the present process the applicator 42 applies a sheet of colorless viscous gum to the tufted face of the carpet over the entire width of the carpet web. This gum is a water base vegetable gum solution which is chemically inert with respect to later applied dyes. Chemically inert implies that there is no chemical reaction between the gum and the dye. The carpet web is oriented horizontally at this point. The web of carpeting is then pulled horizontally over guide rollers by drive roller 44 through machines 46 and 48.

Machine 46 comprises two identical, separate drop dispensing applicators 50 and 52 which are opposite and facing each other. Machine 48 also comprises two separate and independent identical drop dispensing applicators 54 and 56. Applicator 54 has the capability of dispensing drops (or streams) of a liquid in a zig-zag pattern over spaced areas 38*a–d*, FIG. 3, and is sometimes referred to as a multi-TAK machine. Applicator 56 has the capability of dispensing drops (or streams of a liquid) in a pattern similar to areas 38*a–d* but in different regions. Applicators 50, 52 and 56 are not in use in the present embodiment. For purposes of the following discussion, "drops" will be referred to by way of example but it is to be understood that this is intended to be generic to drops, streams and so on. Note in FIGS. 1 and 3 that the direction of the carpet movement is as indicated by arrow 43.

The machine 46, on the other hand, is capable of dispensing drops (or streams) of liquid randomly over the entire tufted face of the carpet and is referred to as a TAK machine. A machine similar to machine 48 is illustrated in U.S. Pat. No. 3,964,860 and a machine similar to machine 46 is described in U.S. Pat. No. 4,010,709.

The carpet material is then conveyed downward into a tension compensating loop 58 and then upward to an elevation above the level of the carpeting 12 in the machines 46 and 48, to roller 60. The web of carpeting traverses around roller 60 beneath dye applicator 64. The latter, which is of conventional construction, is sometimes known as a Kusters applicator. Dye applicator 64 applies a continuous sheet or layer of dye to the tufted surface of the carpeting, over the entire width of the carpeting. In the application region, the carpeting is horizontally oriented.

Figure 2:
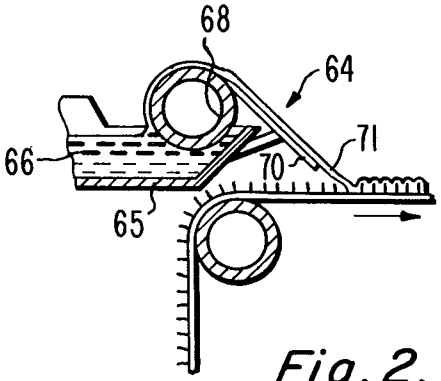
FIG. 2 is a side-elevational view of a portion of the apparatus of FIG. 1.

FIG. 2 illustrates a portion of the dye applicator 64. It includes a pan 65 for receiving a dye 66 and a roller 68. The roller 68 picks up a layer of the dye from reservoir 66 and this layer is brought into contact with the edge of doctor blade 70. The latter peels a sheet 71 of the dye away from the roller and delivers it to the tufted surface of the carpet. The gum applicator 42 includes similar structure, however, a special set of input ports is employed to insure that the viscous gum will be of uniform height, as explained in my copending application Ser. No. 661,396.

The carpet enters the steamer 62 after it passes the applicator 64. The steamer includes a first set of rollers 74 for transporting the carpet in a first horizontal pass in the steamer, a second set of rollers 76 for transporting the carpet in a second horizontal pass in the steamer, this one with the tufts pointing downward, and a third set of rollers 78 for transporting the carpet in a third horizontal pass in the steamer.

The carpet exits the steamer in a substantially downward direction and passes into a washing apparatus 80. The latter has two compartments for washing the carpet and for removing unfixed dye, gum and chemicals from the carpet. The gum viscosity is lowered in the steamer 62 as a result of being heated and is readily removed in the washing apparatus. The remaining excess elements also are readily removed. The washed carpet passes into a suitable container 82 and is later transported to and dried in a drying machine (not shown).

In carrying out the process of the present invention, reservoir 16 in the pad machine 14 is filled with a suitable pre-wet solution formed of water, vegetable gum surfactant, fabric softener, a defoamer and acetic acid all at room temperature having a viscosity preferably in the range of 50 to 120 CPS and a pH in the range of 0 to 7 as discussed above and in one particular process was about 4.

The pH of the bath in reservoir 16 affects what occurs in the steamer. If the pH is alkaline, it serves to slow down the fixation of the dyes in the steamer. This may allow them to wick down to the tuft tips more than desired (for purposes of creating a particular dyeing effect) during the second horizontal pass in the steamer. In the present process, the desired effect is obtained by making the pH of the bath in reservoir 16 relatively acid. This helps quicken the fixing of the subsequently applied liquids in the steamer. This also affects the blending of some of the later applied colors as will be explained. The carpet after being squeezed to the desired percent pick-up, is printed by roller 30. The pre-wet pick-up is preferably 130–140 percent.

The color 1 printing dye is relatively acidic (it is at a pH of about 3) to insure the pattern which is printed on the carpet by roller 30 fixes relatively quickly in the steamer. It is desired that the printed tufts remain colored with color 1 throughout the process, to ensure its effectiveness as a background color. This color is printed in about the upper 90 percent of the tufts. In the finished product, the portion of the overall pattern in the color 1 dye does not dominate the design and this is desired. The printing dye adds additional liquid to the printed tufts. This results in a cumulative wet pick-up of about 220–240 percent in the printed portion of these tufts. The color 1 dye may have a viscosity in the range of 50 to 1200 CPS. The desired effect determines the viscosity. The lower the viscosity, the more subtle the effect, i.e., increased muting of color 1. The higher viscosity (within the range stated) the stronger and more predominant the coloring of the tufts.

The sheet 72 of relatively viscous colorless gum and water mixture (or other suitable liquid carrier) applied to the face of the carpeting preferable has a viscosity of about 1800 CPS but can lie within a range of about 600–5000 CPS. This sheet of gum may be a quarter of an inch thick and is of uniform thickness when applied across the entire face of the carpet.

The gum applied to the carpet tends to sink into the spaces between the tufts and to coat varying portions of the tufts, as will be discussed in detail later. The depth to which the gum penetrates will vary at different parts of the carpet. In general, the viscosity of the gum is sufficiently high that it does not sink all of the way to the carpet backing, although this may occur in isolated small regions.

In the present process, the machine 46 for applying drops of liquid is not in use and there is a relatively long distance between the applicator 42 and the first drop applicator 54. In one example, this distance is roughly 12½ feet. The carpet traverses this distance in about 25 seconds. A gum viscosity of 1,800 CPS is found, in practice, to provide an average depth of gum penetration into the regions of the carpeting in the present process of approximately 20 to 40 percent. This produces one kind of effect in the finished product. Lower gum viscosities permit deeper average gum penetration and higher gum viscosities shallower average penetration for different effects in the finished product for a given tufting density, lay of the tufts, and time for penetration. Where, as in the present process, most tufts are laying over due to squeezing action of machine 14 and print roller 33 which prints over most of the tufts, the average depth of penetration is about 20 percent.

The pH of the gum used in the process is significant. The higher the pH of the gum, the less the dye exhausts in the regions of the tufts coated with or saturated by the gum, that is, when the carpet reaches the steamer very little of the acid dye will fix to the tufts covered or saturated by a substantially higher pH gum. For example, if the pH of the gum were very high, say 10.5 a minimum amount of the acid dye (say of pH 3) would fix to this tuft. In practice, the gum may have a pH of 5.5–6, as an example, and this does have an effect on the ability of a later applied dye to fix to a tuft coated with this gum. This slows the fixing of the dyes in the steamer permitting some coloring affect to occur in the steamer as will be explained.

The applicator 54 contains a second dye in a particular color (color 2). This dye may have a viscosity of about 600 CPS in this example. This viscosity may be within a range of 600 to 1200 CPS. The dye formulation is conventional. Dyes suitable for use with nylon carpeting are preferably water soluble acid dyes. In general, the dye may be formulated by mixing a number of different primary color dyes to form the desired color shade. The dye is selected to be compatible with the particular synthetic, natural or mixtures of fibres in the particular tufts being dyed.

There are a number of factors which must be considered in choosing the viscosity of the color 2 dye. The viscosity must be sufficiently high that it masks those tufts or the portions of the tufts the color 2 dye reaches from the lower viscosity later Kusters applied color 3 dye (applied at 64). For a Kusters applied color 3 dye, a viscosity of at least about 600 CPS is used to carry out this function. The higher the viscosity of the color 2 dye, the greater its shielding effect, for a given color 3 dye viscosity. The viscosity of color dye 2 also should be sufficiently low that the drops of the color 2 dye readily can penetrate into (and through) the sheet of gum (applied at 42). For a gum viscosity of 1800 CPS the color 2 dye viscosity should not be higher than about 1200 CPS. If the gum viscosity is greater than 1800 CPS, then the color 3 dye viscosity can be greater than 1200 CPS; similarly, if the color 3 dye viscosity is lower than 50 CPS, the color 2 dye viscosity can be lower than 600 CPS. The lower the viscosity of the color 2 dye the quicker the penetration of the color 2 dye through the gum, for a given gum viscosity, all other things being equal. Within the range specified, different viscosities chosen for color 2 dye will cause different dyeing effects, generally in subtle ways.

Figure 3:
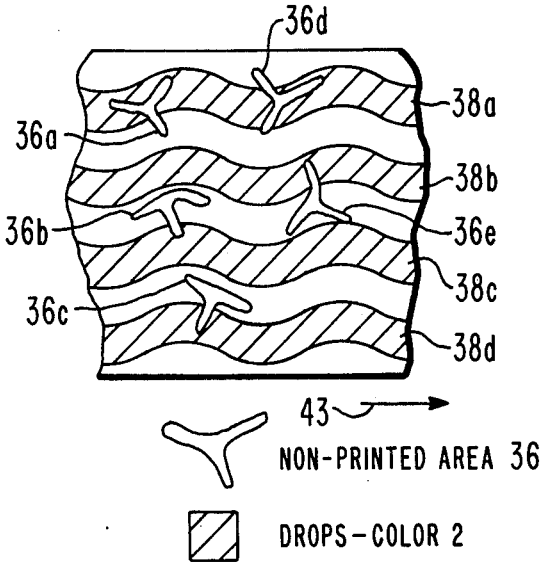
FIG. 3 illustrates some of the patterns produced by the apparatus of FIG. 1.

Applicator 54 dispenses its liquid in drops and the drops are confined to the spaced areas 38*a–d*, FIG. 3. in the particular design illustrated, the dye drops produced by applicator 54, fall on regions which are spaced from one another by intermediate regions which are not reached directly by the drops (although there may be some splashing). The gum and dye 2 penetrate sufficiently by the time the carpet reaches roller 44 to provide almost the finished coloring affect at this time, not withstanding dye 3 is yet to be applied.

The reservoir of applicator 64 is filled with a third dye in another shade or color, call it color 3, which has a substantially lower viscosity than the color 2 dye. For example, if the color 2 dye has a viscosity of 600 CPS the color 3 dye may have a viscosity of from 15–60 CPS, but could vary from this somewhat to achieve its desired effect, as will be explained.

While the dyes disclosed herein are water soluble acid dyes, for use on nylon yarns, it should be understood that other yarn material, and also other types of dyes that are suitable for these other material may be used instead.

Each of the dyes may be prepared and selected from available colors in the manner described in detail in the aforesaid copending application Ser. No. 851,418, filed Nov. 14, 1977. The pH of the three dyes used are acidic (they may have a pH of 3 or so), so that the dyes will fix relatively quickly in the steamer 62. This pH value is not critical and could vary. In one particular process, it is estimated that about 90–95 percent of the dyes become fixed during the first horizontal pass of the carpet within the steamer 62. The remaining dye may wick down the tufts when upside down in the steamer during the second pass and color the tufts tips with a light shade of dye.

Figure 4:
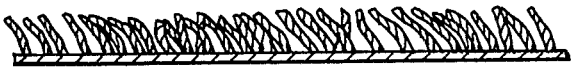
FIGS. 4 and 5 are fragmentary cross-sectional views taken through the carpet after the different steps in the process.
Figure 5:
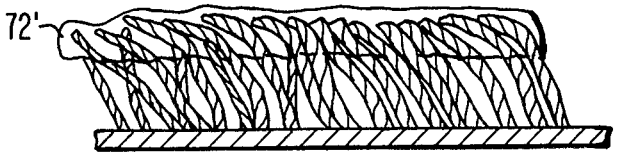

The various steps in the dyeing process are illustrated in FIGS. 4–5. FIG. 4 shows the bent over tufts after printing. FIG. 5 shows the gum 72 applied by the applicator 42 after the carpet has moved a distance from the point application of the gum and before this section of the carpet has reached the applicator 54. The gum coating 72' penetrates into the carpet tufts to an average depth of 20–40 percent or so as discussed above. In the compressed areas, which comprise most of the carpeting, with the tufts laying over and printed, the density of the tufts and liquid concentration in these tufts is higher than in the fewer non-printed areas. The film of viscous gum 72', therefore, penetrates more slowly. In a relatively few areas, some of the tufts may be upright or more loosely packed and some of the gum may penetrate more deeply.

As the carpet traverses beneath the applicator 54, drops 94 of the second dye fall onto the carpet face. As a result of the force of gravity, the drops 94 tends to penetrate through the gum applied by applicator 42. Where the tufts are upright, the color 2 dye may penetrate deeply, in some cases 100 percent, that is to the backing. Where the tufts have been compressed and bent over, the color 2 drops generally do not penetrate through the gum 72' coating as deeply as where the tufts are upright or less densely packed, i.e., where the lay of the tufts is such that there are open spaces between the tufts. The effect, with areas printed in color 1 and receiving also color 2 is a muting and blending of these two colors with a pleasing gradation of colors in the finished pattern. The color 2 dye is visible on the finished carpet.

The drops of color 2 dye may "swim" in the gum on top of the printed (and compressed and bent over) tufts for a relatively long period of time. That is, the dye may mix with the gum but not penetrate into the tufts. As the material is transported, some of the color 2 reaches the tufts and colors them and other of this dye remains suspended in the gum over the tufts. In the steamer, when the gum loses its viscosity, the color 2 dye which is "swimming" in the gum may reach the printed tufts and dye them as well.

After receiving the color 2 dye drops, the web material traverses around roller 44 into loop 58 around roller 60 to dye applicator 64. The liquids applied prior to loop 58 having almost fully penetrated at this time are not significantly affected by the vertical traverse prior and subsequent to loop 58. Applicator 64 applies sheet 71 of the low viscosity color 3 dye over the tufted surface of the carpet web. The portions of the tufts coated with the color dye or the gum or gum and color 2 dye are masked from the color 3 dye and the remainder of each tuft becomes dyed in color 3. The tufts or portions coated just with the color 1 dye are receptive to and are dyed by the color 3 dye. Thus, the base regions of most tufts are dyed in color 3 because the gum and previous color 2 dye did not reach these base regions. The tufts which were protected by other tufts over them and which received neither previously applied gum nor color 2 dye become dyed in their entirety in color 3. These are relatively few in number and occur at isolated spaced regions in the finished pattern.

The drops of color 2 dye color the tips of some tufts and color other adjacent tufts to their bases. The carpet appears to have areas of lightly colored patches, background unprinted areas, which appear as lightly colored portions due to the coloring affect that occurs in the steamer (to be explained), patterned deeper shades of color 3 and patterned color 2. All of the colors appear to blend together gradually. The overall effect is one of relatively deeply shaded areas scattered with lightly colored areas i.e., the unprinted pattern and areas of tufts previously protected by the gum.

There is also some coloring which takes place in the steamer itself. For example, as mentioned previously, on the first horizontal pass through the steamer the low-viscosity color 3 dye becomes 90–95 percent or so fixed. In one example, the carpet traverses the first pass somewhat more than one minute to achieve this affect. On this pass, the viscosity of the gum is reduced because of the heat. On the second horizontal pass, the remainder of the less-viscous dye 3, if present on a tuft, may run down that tuft to the tip of the tuft. In the one example, this pass is also somewhat more than one minute. In those tufts which previously had their tips protected by viscous gum, some of the color 3 dye, attenuated in color, may now reach the tip of the tuft and become fixed there due to the lowered gum viscosity. Most tufts are dyed at their tips in this manner. The attenuated color 3 dye cross stains with the print color 1 dye to give a slightly muted coloring effect at the tuft tips. As another effect in the steamer, some of the viscous color 2 dye, sort of swimming in a viscous gum layer over a bent tuft, which has already colored the tuft to some extent, may color the tuft more strongly during the first horizontal pass in the steamer, in view of the reduced gum viscosity.

Figure 6:
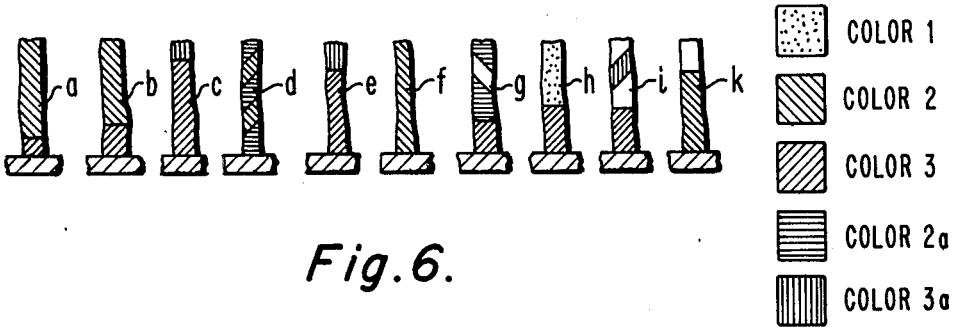
FIG. 6 illustrates the condition of some of the yarn tufts dyed by the process embodying the present invention.

FIG. 6 illustrates some of the individual tufts as they appear in the final product. These are intended as examples only there are many other combinations of coloring effects which occur. Tuft a in FIG. 6 is one which was printed, received a coating of gum on the upper 20 percent and later received a drop of color 2 dye. The latter colored this tuft on the upper 80 percent. The lower 20 percent is colored by color 3. The upper 20 percent gum coated portion is a slightly lighter shade of color 2 than the next lower 60 percent receiving color 2 due to the gum coating.

Tuft b is similar to tuft a but was colored by color 2 on the upper 70 percent and color 3 on the lower 30 percent. Color 2 is also a slightly lighter shade on the gum coated portion.

Tuft c, a printed tuft, was colored on the lower 80 percent by color 3. The upper 20 percent is colored by color 3*a* which stained over the color 1 printed on this tuft. Color 3*a* is about 98 percent lighter in shade than color 3 due to the steamer action which lowered the viscosity of the gum and dyes permitting the unfixed dyes to run and blend. The mixture of color 3*a* with color 1 may produce a slightly off shade, depending on the particular colors of the color 1 and 3 dyes. The color 1 dye is generally selected to be a much lighter shade of color 3 or a contrasting color so as to form an almost imperceptable blend of the two colors 1 and 3*a* most tufts appear as tuft c. For this reason, color 3*a* predominates over color 1.

Tuft d has stripes of color 2 which splashed on one of the twisted yarns forming this tuft. The remainder of this tuft was colored by color 3*a* which is attenuated color 2 about 90 percent lighter in shade than color 2.

Tuft e, an unprinted tuft, was colored on the lower 80 percent by color 3, which due to its much darker shade than color 1, predominates over color 1. The upper 20 percent of the tuft tip was protected by the gum until the second pass of the carpet in the steamer during which the the attenuated color 3, that is color 3*a*, became fixed, as shown. No color 2 reached this tuft.

Tuft f was colored in its entirety by a color 2 drop which penetrated the gum and which masked this tuft from color 3.

Tuft g, a printed tuft, received gum on the upper 60 percent and also a drop of color 2. Some of the gum remained on the tuft in the steamer in sufficient volume to effectively mask one strand of the tuft in the upper 60 percent from colors 2*a* and 3*a*. The lower 40 percent was colored by color 3. The remaining strands in the upper 60 percent was colored by color 3. The remaining strands in the upper 60 percent in which the gum ran off was colored by a color 2*a* which dominates over color 3*a*. This tuft was protected from color 1 during the printing by overlaying tufts.

Tuft h was printed on the upper 60 percent by color 1 which was later protected by a heavy layer of gum from color 3*a*. Color 3 colored the lower 40 percent of this tuft. No color 2 reached this tuft.

Tuft i was in the unprinted pattern. Some of the upper 50 percent of this tuft was protected from color 3*a* by the gum. Some of the upper 50 percent was unprotected from color 3*a* and was colored in the steamer. The lower 50 percent was colored by color 3.

Tuft k is one which was protected from the printer by overlaying tufts. The upper 20 percent may have lain in a pool of gum while the lower 80 percent was splashed with color 2. The gum protected the tip from coloring in the steamer and from colors 3 and 3*a*. Color 2 protected the base portion from color 3.

While particular droplet applicators have been described, the manner of applying the gum and color 2 may vary from that shown as long as these are applied in spaced regions of the carpet, rather than to all of the tufts. Since the gum and high viscosity dye act as a shield to the low viscosity color 3 dye, there is no registration problem for the color 3 dye and it may be applied right over the gum and the color 1 and 2 dyes, in the manner shown.

The following are specific examples of processes embodying the present invention:

EXAMPLE 1

The textile is a 12 or 15 foot wide carpet comprising backing material tufted with nylon yarn. This carpet first is treated with the following pre-wet solution in the pre-wet bath.

0.34 kg: Acetic Acid
6.81 kg: "Pomoco JW" a tradename of Piedmont Chemical Industries, Inc., North Carolina which is a long chain fatty alcohol amide with anionic surfactant
11.35 kg: "Chemcoloft 75-N" a tradename of a Chemical Processing of Georgia Company which is a fabric softener formed of a fatty imidazoline polyethylene emulsion
1 kg: "Quadafoam MA" which is a tradename for Quaker Chemical Corp. North Carolina which is a modified silicone base formed of silicone and chlorinated parafin used as a defoamer
6.25 kg: Syngum D47D a vegetable gum manufactured by the Steinhall Company or General Mills The above ingredients are dissolved in sufficient water at room temperature to produce a 5000 lb. mixture having a pH of 4. In more detail, the mixture is preferably prepared as follows. A premeasured tank is filled about half-way with tap water heated to room temperature. The gum is added and then mixed. The remaining chemicals are then added to a predetermined level to produce the desired 5000 lb. mixture. This mixture is then mixed for about two hours. Similar procedures are followed for the gum and dyes described below. In all cases where acids are used, they should be the last ingredients added. This solution is placed in the pad machine 14. The carpet is run at 30 feet per minute through the pre-wet solution in the pad applicator with 30 lbs. per square inch of roller pressure on the pre-wet solution providing 140 percent pick-up of the pre-wet solution. The carpet tufts are then printed over spaced regions with the color 1 first dye.

COLOR 1, PRINTER 4.09 kg: "Progowet FS" a tradename of the Chemical Process of Georgia Company which is an ethoxylated alcohol.
4.08 kg: Formic Acid
6.00 kg: Syngum D47D
1.36 kg: Quadafoam MA
0.270 kg: Acid Blue 277 Tap water The above ingredients are mixed with the tap water heated to room temperature to make a 3000 lb. mixture having a pH of 3 and a viscosity of 200 CPS.

GUM 1, APPLICATOR 42

4.54 kg: Syngum D47D manufactured by the Steinhall Company or General Mills
0.454 kg: Quadafoam Ma
0.454 kg: DXN, a preservative, dimethoxano
0.068 kg: Acetic Acid The above ingredients are dissolved in sufficient tap water at room temperature to obtain a liquid 1000 lb. mixture having a viscosity of 1800 CPS and a pH of 5.5–6.

COLOR 2, APPLICATOR 54

2.72 kg: Progowet FS
2.72 kg: Formic Acid
5.6 kg: Syngum D47D
0.4 kg: Quadafoam MA
0.4 kg: H-100 a tradename of WACO Chemical Company of Dalton, which is a chelating agent or water softener, comprising ethylene diamine tetra acetic acid (EDTA)
0.060 kg: Acid Yellow 219
0.09 kg: Acid Red 337
0.300 kg: Acid Blue 277

The above ingredients are mixed with sufficient water at room temperature to produce a 2000 lb. mixture with a pH of 3 and a viscosity of 600 CPS. This mixture is applied to patterned areas in drop form.

COLOR 3, APPLICATOR 64

8.16 kg: Formic Acid
7.5 kg: Syngum D47D
1.2 kg: Quadafoam MA
1.2 kg: H-100
1.008 kg: Acid Yellow 219
0.576 kg: Acid Red 337
11.70 kg: Acid Blue 40

The above ingredients are mixed with sufficient tap water at room temperature to make a 6000 lb mixture having a pH of 3 and a viscosity of 50 CPS. This mixture is applied to the entire carpet as a sheet. The carpet with the gum and the three dyes is then transported while horizontal into the steamer unit for fixing the dyes to the tufts. The steamer unit is a three-pass unit in which in the second pass the carpet tufts are upside down.

EXAMPLE 2

The material is the same as in example 1. The pre-wet mixture is the same as in example 1, at 140 percent pick-up.

COLOR 1, PRINTER 1.368 kg: Acid Yellow 219
0.306 kg: Acid Red 337
0.126 kg: Acid Blue 277

The remaining ingredients are the same as in Example 1. The above ingredients are mixed with sufficient tap water at room temperature to make a 3000 lb. mixture having a viscosity of 200 CPS and a pH of 3.

GUM 1, APPLICATOR 42

The gum mixture is the same as in Example 1.

COLOR 2, APPLICATOR 54

0.540 kg: Acid Yellow 49
0.072 kg: Acid Red 337
0.054 kg: Acid Blue 40

The remaining ingredients are the same as in Example 1.

The above ingredients are mixed together to make a 2000 lb. mixture having a pH of 3 and a viscosity of 600 CPS.

COLOR 3, APPLICATOR 64

10.8 kg: Acid Yellow 24
3.6 kg: Acid Red 337
7.2 kg: Acid Blue 140

The remaining ingredients, pH and viscosity are the same as in Example 1.

In all the above examples the pH may be set to the desired value by adjusting the amount of acid added to amounts different than in the examples due to variations in pH in the water and the other elements added.

Nylon carpeting produced in accordance with the examples above contained multi-color hues in which the dyes colored by applicators 54 and 64 were separately visible on the finished carpet. The unprinted pattern appeared as a lighter pattern. Additional variations of shadings were observed from dark to light colors exhibiting in the depth of color applied by applicator 64. The overall impression was that of a pleasing multi-hued effect.

It is to be understood that particular compostions or numbers of dyes used in the two examples above are not critical to the invention. While the dyes formulated in the examples above were made with a water base, it would be equally apparent that dyes with other bases having a different viscosity could also yield similar effects.

What is claimed is:

1. A tufted nylon textile material dyeing process comprising:

wetting the textile material with an aqueous pre-wet solution, having a viscosity of 50–120 cps and a pH of about 4 squeezing a portion of the pre-wet solution from the textile material, printing a pattern on the textile face with a first aqueous acid dye solution at a first viscosity in the range of 50–1800 CPS, applying a layer of a colorless aqueous gum solution to the face of the textile material, said layer having a second viscosity in the range of 600–5000 CPS, and in a ratio of about 9:1 to the viscosity of the first aqueous acid dye solution transporting the coated wet textile material, applying drops of a second aqueous acid dye solution to the printed and coated wet face of the textile material during said transporting said dye drops having a third viscosity in the range of about $\frac{1}{3}$ to $\frac{2}{3}$ the viscosity of the gum solution, applying a layer of an aqueous acid dye solution over said wet face during said transporting, said dye solution layer having a fourth viscosity of about 10% or less the viscosity of the drops of dye solution so as to be substantially masked by those portions of the textile material receiving said layer of gum solution and second dye solution, and steaming said textile material to fix the dyes of said dye solution to said textile material and reduce the viscosity of said gum solutions.

2. The processing as set forth in claim 1 wherein said pre-wet solution includes an aqueous gum solution having a pH of 4, the first dye solution having a pH of 3, the gum layer solution having a viscosity of 1800 CPS and a pH of about 5.5–6, the second dye solution having a viscosity of about 600 CPS and a pH of 3, and the third dye solution having a viscosity in the range of 30–60 CPS and a pH of 3.

3. The process of claim 1 wherein the ratio of said second viscosity to said fourth viscosity is about 30:1.

4. The process of claim 1 wherein said first viscosity is about 200 CPS, said second viscosity is about 1800 CPS, said third viscosity is about 600 CPS and the fourth viscosity is in the range of about 15–60 CPS.

5. A dyeing process for continuously dyeing a nylon tufted carpet comprising:

wetting the tufts with a first aqueous gum solution having a viscosity of 50–120 cps and a pH of about 4, compressing the tufts, printing the carpet in a first pattern with a first aqueous acid dye solution at a first viscosity in the range of 50–1800 CPS and a first pH of about 3, applying a layer of a second aqueous gum solution to the carpet tufts, said layer having a second viscosity in the range of 600–5000 CPS and in a ratio of about 9:1 to the viscosity of the first aqueous acid dye solution and a second pH of aobut 5.5–6, applying drops of a second aqueous acid dye solution to the printed and coated wet tufts of the carpet, said dye drops having a third viscosity in the range of about $\frac{1}{3}$ to $\frac{2}{3}$ the second viscosity and a third pH of about 3, saturating the tufts with a third aqueous acid dye solution having forth viscosity of about 10% or less of either one of the second and third viscosity values and a fourth pH of about 3, so that the third dye is masked from the tufts or portions thereof receiving either said gum or second dye, and steaming the carpet to fix the dyes of said dye solutions to the tufts.

6. The process of claim 5 wherein the pH of said first gum solution is about 4.

7. A method of dyeing a moving, tufted-nylon-carpet web, in a continuous process comprising the steps of:

prewetting the carpet web in an aqueous solution of 50–120 cps viscosity which includes a vegetable gum for binding the tufts together so that when they are compressed during the following printing step, they tend to retain their compressed condition;

printing a pattern in a first dye color on the tufted surface of the moving carpet web with a first aqueous acid dye solution having a viscosity in the range of 50–1800 CPS, compressing the tufts which receive the dye solution;

after the printing step above, applying a sheet of a second aqueous gum solution having a viscosity in the range of 600–5000 CPS over the entire tufted surface of the moving web while the web is substantially horizontal;

applying drops of a second aqueous acid dye solution to the gum wetted surface of the moving carpet web, the second dye solution having a viscosity in the range of about $\frac{1}{3}$ to $\frac{2}{3}$ the second gum solution viscosity;

then flooding the tufted surface of the moving carpet web with a third aqueous acid dye solution which has a viscosity of about 1/30 or less the viscosity of the second gum solution viscosity; and then steaming the carpet.

8. The method as set forth in claim 7, wherein the carpet is steamed first while the tufted surface of the moving web faces up and then while the tufted surface of the moving web faces down.

9. The method as set forth in claim 7 wherein the pH of said pre-wet solution is about 4, the pH of said first, second and third dye solution are each about 3, and the pH of said second gum solution is aobut 5.5–6.

10. The method as set forth in claim 7 wherein the first dye solution has a viscosity of about 200 CPS, the second dye solution has a viscosity of about 600 CPS and a third dye solution has a viscosity of about 15–60 CPS, and said gum has a viscosity of about 1800 CPS.

* * * * *